US005495703A

United States Patent [19]

Kruit et al.

[11] Patent Number: 5,495,703

[45] Date of Patent: Mar. 5, 1996

[54] PROCESS AND AN APPARATUS FOR PACKAGING CONTAINERS IN A CARRIER IN TWO ROWS OF EACH AT LEAST TWO PIECES AS WELL AS A BLANK TO BE USED THEREIN

[75] Inventors: Jan P. Kruit, Gouda; Nicolaas P. Verwey, Leiden, both of Netherlands

[73] Assignee: Heineken Technical Services, B.V., Amsterdam, Netherlands

[21] Appl. No.: 233,077

[22] Filed: Apr. 26, 1994

[30] Foreign Application Priority Data

Apr. 28, 1993 [NL] Netherlands ..... 9300727

[51] Int. Cl.[6] ..... B65B 21/02; B65B 43/10; B65B 5/08

[52] U.S. Cl. ..... 53/398; 53/456; 53/449; 53/48.1; 53/252

[58] Field of Search ..... 53/398, 452, 456, 53/448, 449, 48.8, 48.9, 252, 48.1, 580

[56] References Cited

U.S. PATENT DOCUMENTS

| | | | |
|---|---|---|---|
| 2,747,767 | 5/1956 | Bergstein . | |
| 2,754,028 | 7/1956 | Bergstein . | |
| 2,798,603 | 7/1957 | Grinspoon | 53/398 X |
| 2,917,877 | 12/1959 | Fisher | 53/398 |
| 3,543,472 | 2/1968 | Hickin | 53/398 |
| 3,772,846 | 11/1973 | Mueller | 53/398 X |
| 3,967,772 | 7/1976 | Baker | 53/456 X |
| 4,263,769 | 4/1981 | Hanazawa et al. | 53/448 |
| 4,286,709 | 9/1981 | Manizza . | |
| 5,160,023 | 11/1992 | Adams et al. | 53/448 X |
| 5,178,268 | 1/1993 | Talley et al. | 53/448 X |

FOREIGN PATENT DOCUMENTS

| | | |
|---|---|---|
| 666901 | 2/1952 | United Kingdom . |
| 1568570 | 6/1980 | United Kingdom . |

*Primary Examiner*—Horace M. Culver
*Attorney, Agent, or Firm*—Varnum, Riddering, Schmidt & Howlett

[57] ABSTRACT

A process and an apparatus for packaging containers in a carrier in two rows, in which a first half carrier is formed from a first blank by bringing a bottom portion into a horizontal position, placing a first longitudinal wall portion perpendicularly thereto, folding two side wall portions and partition flaps cut from the first longitudinal wall portion into a position perpendicular to the first longitudinal wall portion, inserting containers between the side wall portions and the flaps and bringing a second longitudinal wall portion into a position parallel to the first longitudinal wall portion and connecting it with the side wall portions, after which, in a similar manner, a second half carrier with containers is formed from an identical blank and both half carriers are composed by connecting two corresponding longitudinal wall portions to form a carrier with two rows of containers. The blanks can be made with a minimum of waste material.

16 Claims, 6 Drawing Sheets

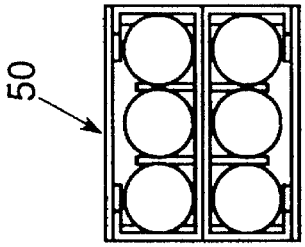
FIG. 16
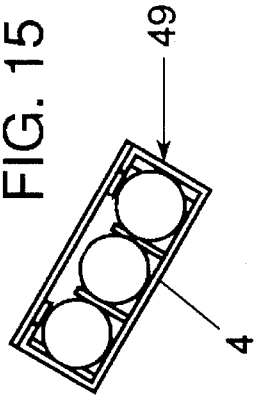
FIG. 15
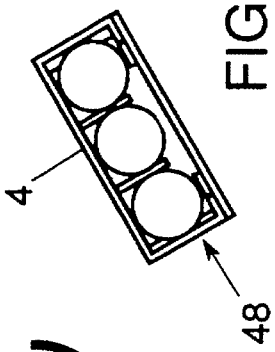
FIG. 12
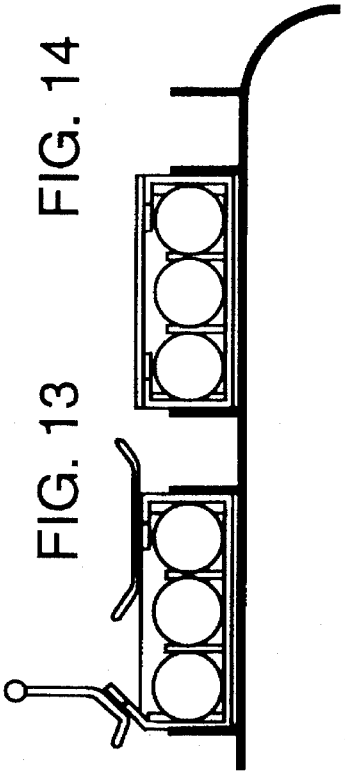
FIG. 14
FIG. 13
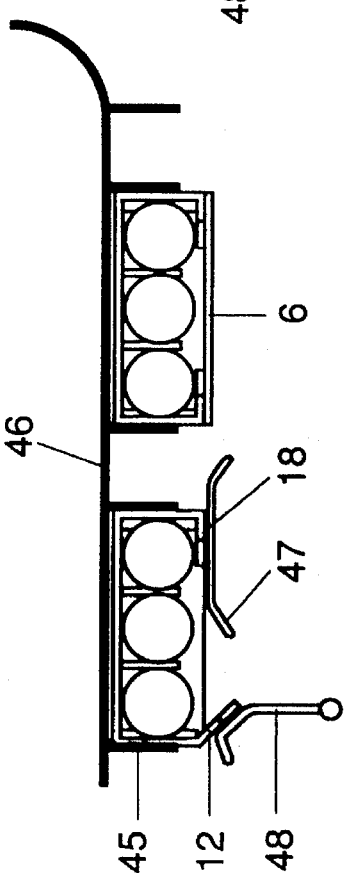
FIG. 11
FIG. 10

PROCESS AND AN APPARATUS FOR PACKAGING CONTAINERS IN A CARRIER IN TWO ROWS OF EACH AT LEAST TWO PIECES AS WELL AS A BLANK TO BE USED THEREIN

BACKGROUND OF THE INVENTION

This invention relates to a process for packaging containers in a carrier in two rows of each at least two pieces, in which process the containers are fed in rows to place them in the carrier and the carrier is made from two blanks and is at least partly erected around the containers and glued up. This invention also relates to an apparatus for carrying out such a process as well as to a blank to be used therein.

A process as referred to in the preceding paragraph is known from U.S. Pat. No. 2,276,129. In this process a semi-manufactured carrier is made from two substantially equal blanks, which semi-manufactured carrier can be stored and transported in substantially flat form. For filling with containers, the semi-manufactured carrier must be folded out in hat form and pushed from above over a group of two rows of bottles. The bottle necks must then move along two freely hinged, suspending flaps, which may cause problems, breakdown and fracture of containers upon improper contact between the bottles and the flaps. After completion of pushing on the hat form, the carrier is closed around the bottles by folding two bottom flaps, which initially extend vertically downwards, towards each other and securing them together. During this folding up, the bottles, while being supported on a stationary plate, are pushed further by laterally engaging conveyors. An appreciable disadvantage of the carrier with containers thus obtained is that a partitioning is lacking, so that the bottles may bump each other, which not only causes sound nuisance but first has a disfiguring effect on the appearance of the bottles and may then lead to damage and even to fracture.

Further, British Patent specification 2 086 350 discloses a process in which first a partition wall with a partitioning is formed, which is then pushed over a group of bottles, after which a tray-like body is formed around the combination thus obtained, which tray-like body is glued to the partition wall with partitioning. In this manner, mutual contact between the bottles in the package is indeed avoided, but the problems caused by pushing on continue to exist. Further, the carrier is composed of two quite different blanks, one blank being composed and erected before and the other during contact with the bottles. Both the mutually different shapes and the methods of treatment of the blanks each cause specific logistic problems. Moreover, the blanks require relatively much material owing to the irregular shape of their outer circumference, i.e. there will be relatively much waste when forming the blanks.

SUMMARY OF THE INVENTION

It is an object of this invention to carry out a process of the type defined in the opening paragraph in such a manner that a carrier is formed around a group of bottles and between bottles of a group by a relatively simple method, without problems caused by a container bumping against a more or less freely movable free edge, and without problems arising from the mutual contact of the containers packaged in a carrier. It is also an object of the invention to provide compact storage of unfilled carriers so as to minimize transport and storage costs, while the invention also aims at producing the blanks for the carriers with a minimum amount of waste material.

This is achieved according to the invention by feeding a first blank in its flat initial form, bringing a blank section forming a bottom of the carrier into a horizontal position, bringing a blank section forming a first longitudinal wall, which blank section is hingedly connected to the bottom, into a vertically upward position from the bottom, folding at least one partition flap cut from the first longitudinal wall and two blank sections each forming a side wall of the carrier into a vertical position extending perpendicularly to the first longitudinal wall, inserting a container between a side wall and a flap or between two flaps, which container rests on the bottom and is in contact with the first longitudinal wall, bringing a blank section forming a second longitudinal wall, which blank section is hingedly connected to the bottom, into a vertically upward position from the bottom, parallel to the first longitudinal wall, and connecting it both to one and to the other side wall, subsequently, or simultaneously in the same manner, erecting a second blank equal to the first one to form a half carrier in the same manner and filling it, after which both half carriers are directed with a longitudinal wall towards each other and the longitudinal walls facing each other are interconnected to form a carrier with two rows of containers.

Since this process starts from a blank in its initial form, transport and storage are possible in a particularly compact manner, the more so as two identical blanks are used to form the carrier. The latter step also enables row-wise treatment of the containers to be packaged, so that no parts of the carrier need to be pushed between two rows of containers. Further, this enables the use of freely hinged partitioning flaps formed from a longitudinal wall, while during insertion of the containers between the flaps against the longitudinal wall the flaps can be stopped from the other still free side of the longitudinal wall. That the containers can be inserted in this advantageous manner is possible by folding up and securing the second longitudinal wall only after that operation. A half carrier thus formed is finally composed with a similar half carrier to form the required carrier.

In order to minimize movement during insertion, it is preferred according to a further embodiment of the invention that before inserting the containers the blank section forming the second longitudinal wall is folded into a position extending vertically downwards from the blank section forming the bottom.

The blank sections forming the second longitudinal wall and the side walls may be interconnected by various methods, e.g. by gluing in corner pieces or mechanically securing the walls together by mutually stapling or clamping. According to a further embodiment of the invention, however, it is preferred that after inserting the containers tab-shaped sections hingedly connected to the blank sections forming the side walls are directed towards each other in a position parallel to the blank section forming the first longitudinal wall, after which the blank section forming the second longitudinal wall is connected to the folded tab-shaped sections during or after bringing it into the vertically upward position. Thus a fully closed transition between the second longitudinal wall and the side walls can be realized in a relatively simple manner.

In order to enable a filled carrier to be handled in the usual manner, the blank sections forming the longitudinal walls to be interconnected are further provided with handle means, which longitudinal walls are preferably formed by the blank sections forming the first longitudinal walls.

In order to form a half carrier by the processes described above, there is preferably used according to the invention a blank provided with a first rectangular blank section having a first and a second long side and a first and a second short side with a length substantially equal to a first transverse dimension of a container to be packaged, to which first and second long sides a second and a third rectangular blank section are hingedly connected symmetrically with respect to the first blank section, which second and third blank section, at the location where they are connected to the first blank section, each have a first longitudinal side with a length substantially equal to a second transverse dimension of the container, perpendicular to the first one, multiplied by the number of containers to be placed in a row, which second blank section has two longitudinal sides perpendicular to the first one, each having a dimension substantially equal to that of one of the short sides of the first blank section plus that of one of the longitudinal sides of the third blank section extending transversely to the first longitudinal side and to which two longitudinal sides of the second blank section are hingedly connected a fourth and a fifth blank section, each having, perpendicular to the hinged connection, a dimension substantially equal to the first transverse dimension of a container to be packaged. There is thus obtained a substantially T-shaped blank, the height of the bar of which T-shape is equal to the length of the leg of the T-shape, so that blanks can be cut from a sheet of starting material, substantially without loss of material, because the T-shapes alternately fit together while adjoining one another without interspaces.

The difference in height between one longitudinal wall and the other longitudinal wall can be met at the transition between the lower longitudinal wall and the side walls without a stepped transition when according to a further embodiment the fourth and fifth blank sections have a longitudinal side running parallel to the hinged connection and having a length equal to that of the third blank section, a transverse side connecting this longitudinal side and the hinged connection being in line with the hinged connection between the first and second blank sections, to which longitudinal side of both the fourth and fifth blank sections a tab-shaped portion is hingedly connected to enable the fourth or fifth blank section to be interconnected to the third blank section. These tab-shaped portions can be formed by different methods without essentially disturbing the above-described advantageous T-shape.

In order to enable packaged containers to be kept separated from each other in a filled carrier, it is preferred according to a further embodiment of the blank that at least one hinged partition flap is cut loose from the second blank section by providing a first and a second cutting line, which cutting lines run parallel to each other and to the hinged connection between the first and second blank sections, the ends of which cutting lines are on the one hand connected by a further cutting line and on the other hand by a hinge line running parallel to the hinged connection of the second blank section with the fourth and fifth blank sections, while the distance from the hinged connection of the second blank section with the fourth blank section to the cutting line closest thereto is equal to the distance from the hinged connection of the second blank section with the fifth blank section to the cutting line closest thereto and in the presence of more than one partition flap also equal to the distance between two successive hinge lines.

In order to enable a filled carrier to be picked up manually, the second blank section may further be provided in the periphery opposite the hinged connection with the first blank section with an elongated U-shaped cut for forming a handle opening. The portion cut loose from the U-shaped cut can be folded over and secured to the second blank section in order to reinforce the handle area of the carrier. A further reinforcement of that area can be realized by folding over and connecting with the second blank section a piece cut loose from a fourth or fifth blank section continuously adjoining the third blank section. Besides reinforcement, these portions folded back at the location of the handle opening have the further effect that the upper edge of that opening obtains a thicker more rounded shape, thus improving the ease of carrying.

This invention also relates to an apparatus for manufacturing a carrier filled with containers, by the above-described method, by means of two blank sections, as also described above. To this end the apparatus according to the invention is provided with:

- means for transporting a first blank horizontally fed in flattened condition, and
- means for erecting and filling the blank during transport, comprising:
  - means for folding into a vertically upward position the second blank section and the portions hingedly connected thereto, excepting the first blank section which remains in a horizontal position,
  - means for folding the fourth blank section, each partition flap and the fifth blank section to above the first blank section,
  - means for inserting a container between a folded fourth or fifth blank section and an adjoining partition flap as well as between two adjoining partition flaps,
  - means for folding the third blank section into a vertically upward position,
  - means for connecting the third blank section with the fourth and fifth blank sections,
- similar means for transporting and for erecting and filling a second blank section,
- means for placing two erected and filled blank sections with their second blank sections against each other, and
- means for interconnecting two blanks thus placed against each other.

In order to minimize inserting movement of the containers, means may further be provided for folding the third blank section into a vertically downward position combined with or adjoining the means for folding the second blank section into a vertically upward position.

When tab-shaped portions are used for connecting the third blank section with the fourth and the fifth blank section, this can be realized by providing means for folding the tab-shaped portions against a container, which means follow the means for inserting a container and precede the means for folding the third blank section into a vertically upward position.

When according to a further preferred embodiment of the invention the means for folding each partition flap and the trailing fifth blank section to above the first blank section are provided with an endless plate belt in which the transport area extends parallel to the vertically upward second blank section and the plates are arranged perpendicularly to the transport area and at a mutual distance equal to the second transverse dimension of a container to be packaged, means having a double function are advantageously provided. On the one hand these means ensure that the partition flaps and the fifth blank section are brought into a correct position, while on the other hand these means ensure that these portions are kept in the right position during insertion of the containers.

BRIEF DESCRIPTION OF THE DRAWING

With reference to the embodiments shown in the drawings, the process and the apparatus according to the invention as well as the blanks to be used therein will now be discussed and explained in more detail. In the drawings:

FIGS. 5–16 are diagrammatic top views of an apparatus for carrying out the various steps for forming a carrier around a plurality of containers in the manner shown in FIGS. 2–4.

DETAILED DESCRIPTION

Figure 1:
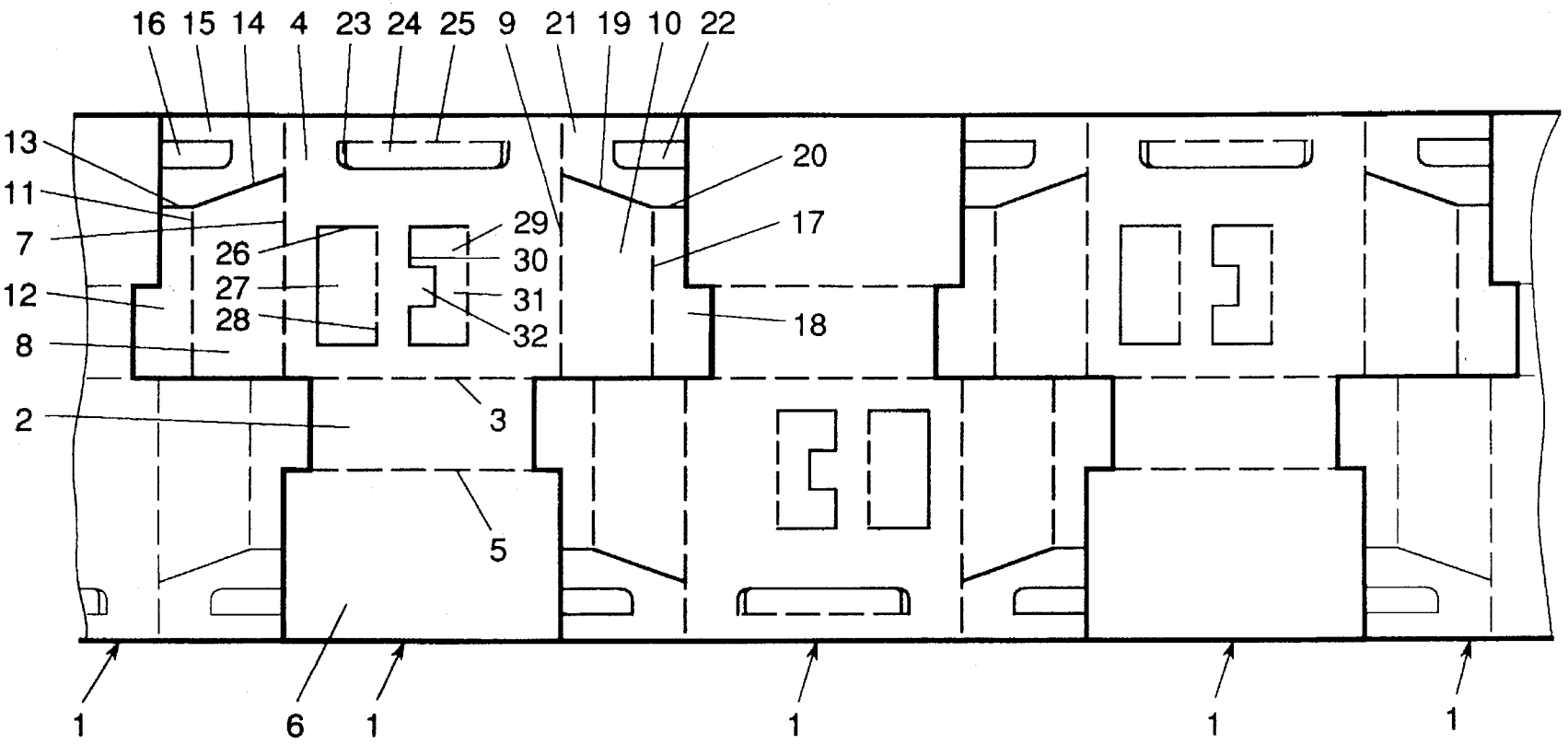
FIG. 1 is a top view of a web of material from which a plurality of adjoining blanks are punched.

In FIG. 1 a web of material, e.g. cardboard, is shown, from which blanks 1 are made to form a carrier. The outer circumference of the blanks 1 is shown by a thick full line, from which it appears that the successive blanks 1 alternately and directly adjoin each other, so that, from a viewpoint of material and waste, the method of manufacturing the blanks 1 is very efficient.

Each blank 1 is provided with a first rectangular blank section 2 having attached thereto a second rectangular blank section 4 via a hinge line 3 and a third rectangular blank section 6 via a hinge line 5. The hinge line 3 is located in the middle of the blank 1, i.e. the dimension of the second blank section 4 transverse to the hinge line 3 is equal to the dimension in that direction of the first blank section 2 plus that of the third blank section 6. The second and third blank sections have the same dimension in the direction of the hinge line 3, while the first blank section 2 has a smaller dimension in that direction, the first blank section 2 being situated such that at both ends it recedes over an equal distance in relation to the blank sections 4 and 6 aligned transversely to the hinge line 3.

Connected to the sides of the second blank section 4 extending transversely to the hinge line 3 is a fourth blank section 8 via a hinge line 7 and a fifth blank section 10 via a hinge line 9. In the direction of the hinge line 3 the fourth and fifth blank sections have a dimension equal to the dimension of the first blank section 2 transverse to the hinge line 3.

The fourth blank section 8 has a side extending perpendicularly to the hinge line 7 in the form of a cutting line which is aligned with the hinge line 3, while perpendicularly to that cutting line a hinge line 11 extends, which forms a further side of the fourth blank section 8 and has a length equal to the dimension of the third blank section 6 perpendicular to the hinge line 3. Connected with the fourth blank section 8 via the hinge line 11 is a tab-shaped portion 12, which has an L-shaped surface, the shape of the projecting portion 12*a* of which is equal to that of the recess between the second and third blank sections as a result of the first blank section receding therefrom. Beside the hinge line 11 the tab-shaped portion 12 is bounded by a cutting line extending perpendicularly to that hinge line and being in line with the hinge line 3, a staggered cutting line substantially extending transversely to the above cutting line and determining the L-shape of the tab-shaped portion 12, and a cutting line 13 connected to the staggered cutting line, which cutting line 13 terminates at the hinge line 11 and extends perpendicularly thereto. The cutting line 13 extends into a cutting line 14, which forms the fourth side of the fourth blank section 8, which cutting line 14 lies at an obtuse angle to the hinge line 11 and terminates at the hinge line 7 at some distance from the edge of the web of material from which the blank sections 1 are cut. Located between the edge of that web and the cutting lines 13 and 14 is a flap-shaped portion 15 which is connected via the hinge line 7 to the second blank section 4 and provided with a slotted cut-out section 16.

The fifth blank section 10 has a shape identical with that of the fourth blank section 8, although this fifth blank section 10 is mirror symmetrical. Likewise similarly connected to the fifth blank section 10 via a hinge line 17 is a tab-shaped portion 18, while cutting lines 19 and 20 separate the fourth blank section 10 and the tab-shaped portion 18 from a flap-shaped portion 21 with a slotted cut-out portion 22.

The second blank section 4 is provided with an elongated U-shaped cut 23, by which a flap-shaped member 24 is cut loose from the second blank section 4, which flap-shaped member remains connected to the second blank section 4 via a folding line 25. Further, by means of a U-shaped cut 26 in the second blank section 4 a first partition flap 27 is cut loose, which remains connected to the second blank section 4 via a hinge line 28. By means of a W-shaped cutting line 30 a second partition flap 29 is partly cut loose from the second blank section 4 and remains connected to the second blank section 4 via a hinge line 31, in such a manner that when the second partition flap 29 swings along the hinge line 31 from the plane of the second blank section 4, a projection 32 extending into the resulting opening remains in that plane. The hinge lines 28 and 31 extend both mutually and parallel to the hinge lines 7 and 9, the distance between the hinge lines 28 and 31 being equal to both the distance between the hinge lines 7 and 28 and the distance between the hinge lines 31 and 9.

In order to make a carrier with containers from blanks shown in FIG. 1, first the flap-shaped portions 15 and 21 are folded along the folding lines 7 and 9 and glued to the second blank section 4. The slotted cut-out sections 16 and 22 are dimensioned and situated in such a manner that the flap-shaped portion 24 is not obstructed in folding along the hinge line 25 against the flap-shaped portions 15 and 21 glued to the second blank section 4, after which the flap-shaped portion 24 is glued in that position. It is observed that the slotted cut-out sections 16 and 22 may contain flap-shaped portions, if desired, which must be folded and secured before folding the flap-shaped portions 15 and 21. Folding and securing the flap-shaped portion 24 results in a handle opening with a locally triple material thickness, in particular along one of the edges of the opening.

Figure 2:
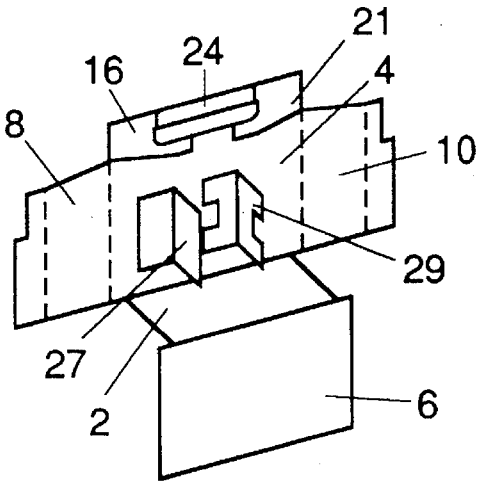
FIGS. 2–4 are perspective views illustrating how a carrier is formed around a plurality of containers from blanks shown in FIG. 1.

After forming the handle opening the first blank section 2 is brought into a horizontal position, the second blank section 4 into a vertically upward and the third blank section 6 into a vertically downward position. Further, the partition flaps 27 and 29 are folded into a position perpendicular to the second blank section 4 to above the first blank section 2, resulting in the position shown in FIG. 2. Before, during or after folding the partition flaps 27 and 29 the blank sections 8 and 10 are brought into the same position as the partition flaps, after which three containers 33 are pushed on the first blank section 2, which containers are kept out of mutual contact by the partition flaps 27 and 29. Subsequently, the tab-shaped portions 12 and 18 are folded and provided with glue on their sides facing away from the containers 33, which results in the situation shown in FIG. 3. By folding up the third blank section 6 and securing it to the tab-shaped portions 12 and 18 the half carrier is completed.

It is observed that the dimensions of the tab-shaped portions 12 and 18 are such that their width exceeds the half diameter of a container 33, so that when the tab-shaped portions and the third blank section 6 are mutually contacted for gluing them together, these parts also rest against the containers 33, which promotes proper gluing without additional steps, because the containers 33 which, in turn, rest against the second blank section 4 provide a counterpressure surface. To achieve this effect and to obtain a proper fit of the containers 33 in the erected blank 1, the dimension of the first blank section 2 transverse to the hinge line 3 must correspond to the diameter of a container 33, while the dimensions of the second and third blank sections in the direction of the hinge line 3 must correspond to three times the diameter of a container 33.

Figure 3:
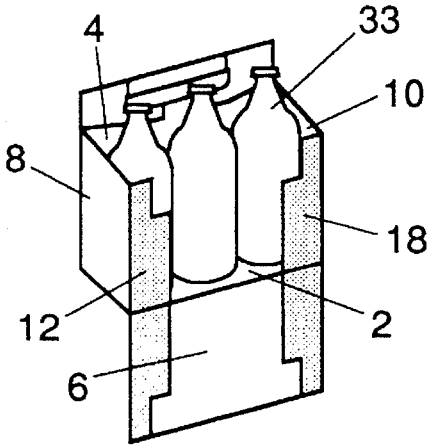

FIG. 3 shows on the third blank section 6 the surfaces that will contact the tab-shaped portions 12 and 18 after swinging up the third blank section 6. Depending on the selected glue, those surfaces must also be provided with glue.

Figure 4:
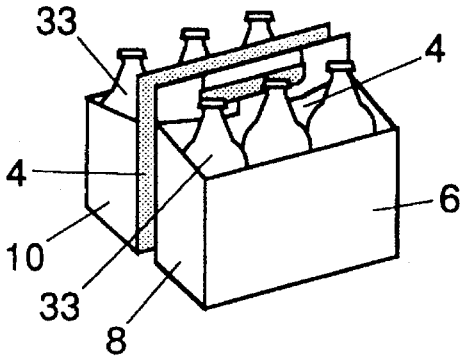

In order to form a carrier from two half carriers made in the above manner, the latter must be provided with glue on the surfaces of the second blank sections 4 facing away from the containers 33 and then be mutually contacted with those surfaces, as shown in FIG. 4. To this end one half carrier must be turned 180° in relation to the other carrier. This means that the opening between the hinge lines 7 and 28 in one second blank section 4, which opening is formed by folding out the partition flap 27, comes to lie opposite the portion, not provided with an opening, between the hinge lines 9 and 31 of the other second blank section 4. The two pairs of outer containers 33 are therefore always separated by a continuous wall formed by one or by the other second blank section 4. At the location of the middle pair of containers 33 two openings are provided opposite each other, although a projection 32 extends into both openings. By means of a proper dimensioning of the projections 32, each half of the width of the opening, a continuous bridge is formed in the middle of the opening, so that also the middle pair of containers 33 is kept out of mutual contact.

Thus a carrier with six containers is obtained, of which carrier the bottom is formed by two first blank sections 2, each longitudinal side wall by a third blank section 6 and each end side wall by a fourth blank section 8 and a fifth blank section 10. The second blank sections 4 form a central partition wall provided with a handle opening, the edge of which contacting the hand when picking up the carrier has a six-fold material thickness, in other words a relatively thick edge giving ease of carrying, while there: is also provided a construction sufficiently strong to enable transport of the carrier without the risk that the handle opening will be torn.

With reference to FIGS. 5–16, an apparatus for the manufacture of a carrier with containers will now be schematically discussed. Because various means for applying glue and mechanisms for folding blank sections are generally known in the present field of the art, it is believed to be unnecessary to show them in the drawings and to discuss them here, with the exception of those mechanisms which perform an essential function for forming a carrier according to the present invention.

Figures 5, 6, 7:
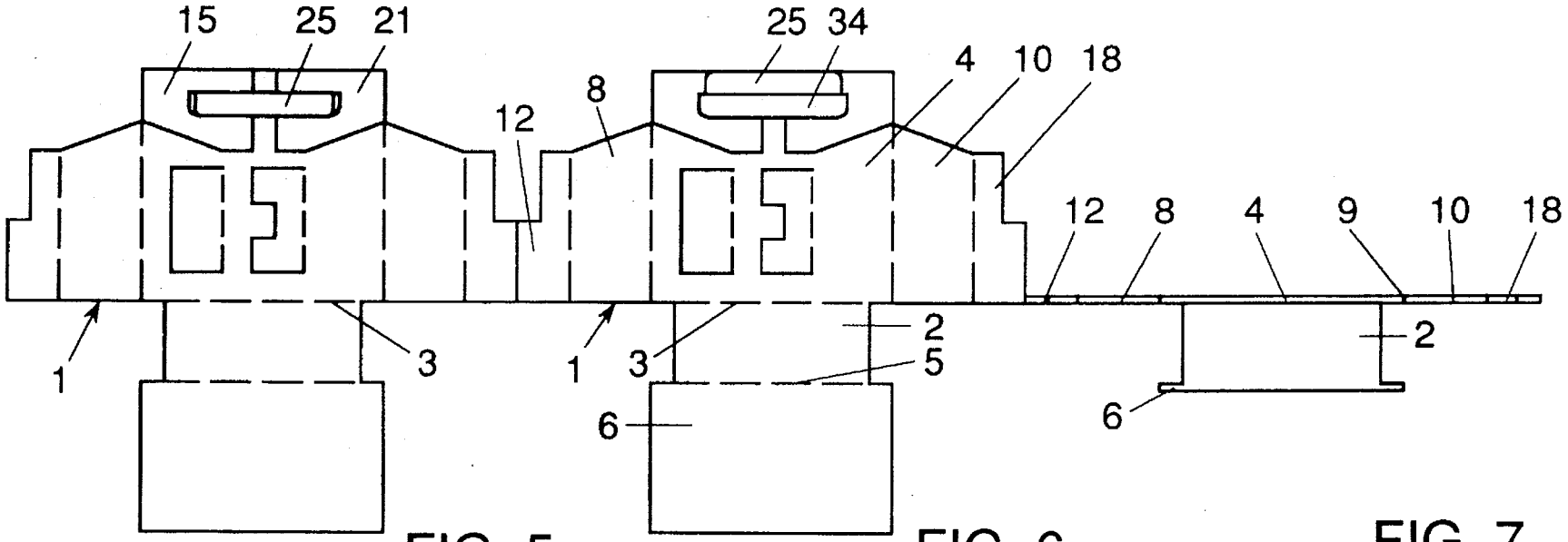

FIG. 5 is a top view of a blank 1 which, lying on a conveyor not shown, e.g. a belt passing round end pulleys, is movable in the direction of the hinge line 3. In the situation shown in FIG. 5 the flap-shaped portions 15 and 21 are already folded and glued, while the flap-shaped member 24 is still in its initial condition. In this track the successive blanks 1 are fed in aligned condition directly adjoining one another, as is indicated by having the blank 1 shown in FIG. 5 directly adjoin the blank 1 shown in FIG. 6, where the flap-shaped member 24, which, together with the flap-shaped portions 15 and 21, was provided with glue, is folded and secured to form a handle opening 34. In the situation shown in FIG. 7 the rate of transport remains the same, but the second blank section 4, together with the blank sections 8 connected thereto and with the tab-shaped portions 12 and 18 connected to the blank sections 8, is brought into a position extending vertically upwards from the plane of the drawing, while the third blank section 6 is folded into a position extending vertically downwards from the plane of the drawing, which situation is comparable to the situation shown in FIG. 2. Subsequently, as shown in FIG. 8, the fifth blank section 10, together with the tab-shaped portion 18 connected thereto, is folded along the hinge line 9 to above the first blank section 2.

In this configuration the second blank section 4 contacts the plates 35 of a plate belt 36. The plates 35 are arranged with spaces substantially equal to the distance between the hinge lines 28 and 31 of the partition flaps 27 and 29. By driving the plate belt at a lower speed than the conveyor mentioned before, the folded fifth blank section 10 comes to lie against the left-hand side, seen in FIG. 9, of a first plate 35. Then a second plate 35 will contact the second partition flap 29 and cause it to swing along its hinge line 31 into a position perpendicular to the second blank section 4. A third plate 35 causes the first partition flap 27 to swing along its hinge line 28 into a position parallel to the second partition flap 29, while a fourth plate 35 brings the fourth blank section 8 with the tab-shaped portion 12 into the same position. Against this fourth plate the next fifth blank section 10 bumps. This results in a situation in which there are provided a bottom formed by the first blank section 2, a back wall formed by the second blank section 4, two side walls formed by the fourth and the fifth blank section and a partitioning formed by the first and the second partition flap. However, a front wall is still lacking. Via this (still) lacking front wall, containers 33 are pushed on the bottom against the back wall and into the partitioning by means of a container inserting device shown in FIG. 9.

This container inserting device is provided with a container feeding device 37 and a conveyor 38 provided with a plurality of juxtaposed members 39 hingedly connected to one another, each member 39 carrying an inserting member 40 movable transversely to the direction of running of the conveyor 38 and having a cam 41 running in a guideway 42. Further, each inserting member 40 has a container contact surface 43 adapted to the circumferential surface of a container 33. The containers 33 fed via the device 37 are successively contacted by an inserting member 40 which, by the cooperation of the cam 41 with the guideway 42, pushes the container 33 on the bottom formed by the first blank section 2. In order to prevent the containers from contacting the plates 35 and to enable withdrawal of the plates 35 from the back wall formed by the second blank section 4, a guide plate 44 is provided which, at the moment the containers can ensure that the partition flaps 27 and 29 are kept in place, contacts the back wall and forces it in the direction of the containers 33.

Figures 8, 9:
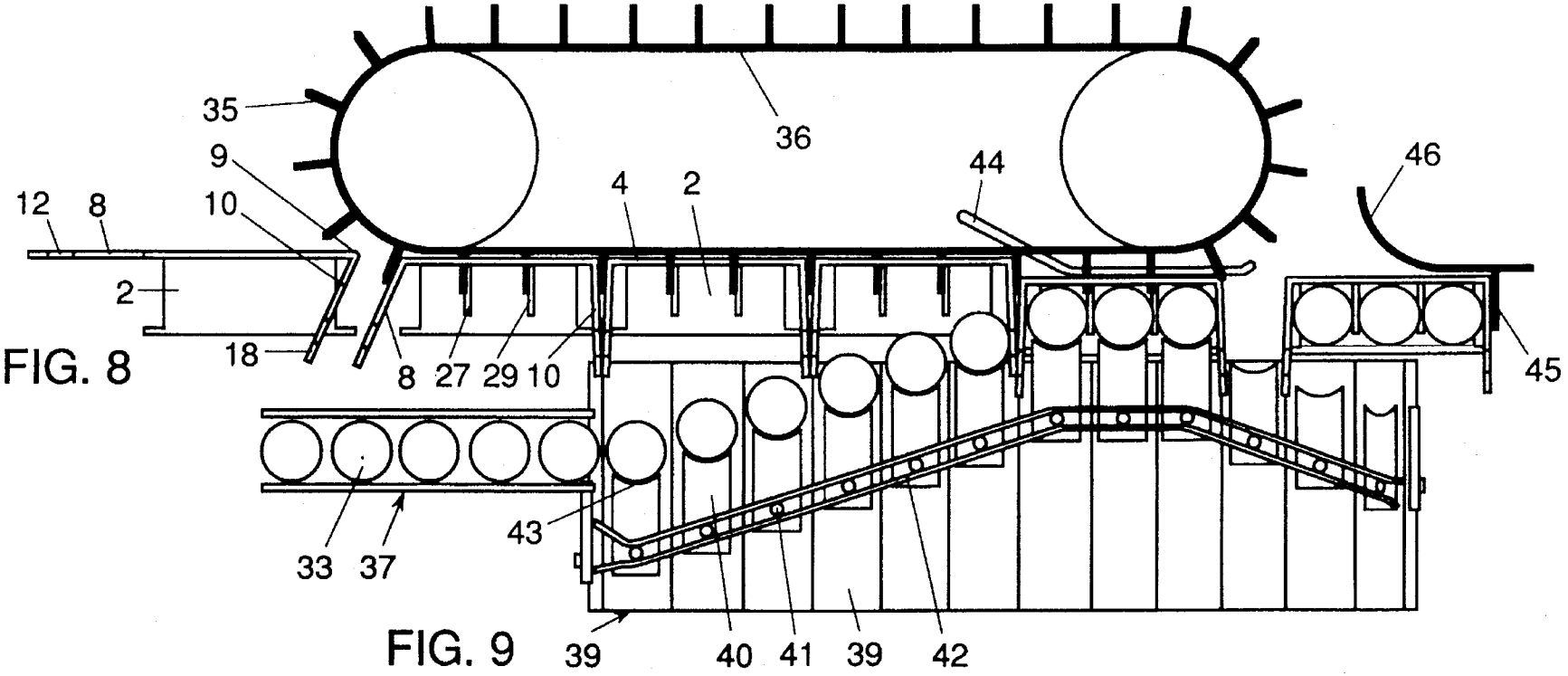

Thus the containers are fully pushed on the bottom and into contact with the back wall, which results in the situation shown at the rightmost side of FIG. 9, in which the rate of transport is increased and the side wall formed by the fifth blank section 10 contacts a plate 45 of a plate belt 46, on which the division of the plates 45 is such that the spaces, created by the increased rate of transport, between the erected blanks with the containers 33 placed therein are maintained. Arranged beside the plate belt 46 is, as shown in FIG. 10, a guide plate 47 which causes the leading fifth tab-shaped portion 18 to swing along its hinge line 17, as well as a rotating folding member 48 which folds the trailing tab-shaped portion 12 in the direction of the containers 33. It will be clear from the drawings that after folding by the folding member 48 the tab-shaped portion 12 will be maintained in this position by the guide plate 47.

After applying glue to the tab-shaped portions 12 and 18 the third blank section 6 is folded up 180° and forced into contact with the glued tab-shaped portions 12 and 18, as shown in FIG. 11. Thus a closing front wall is realized and the half carrier shown in FIG. 12 is obtained.

Similarly, on a secondary track, the last stations of which are shown in FIGS. 13 and 14, a similar half carrier is formed, although this has a mirror symmetrical configuration, as shown in FIG. 15, i.e. the two blank sections 4 of the half carriers 48 and 49 are directed towards each other. The surfaces of the two blank sections 4 directed towards each other are provided with glue and then pressed together, which results in the completed carrier 50 shown in FIG. 16.

Figure 17:
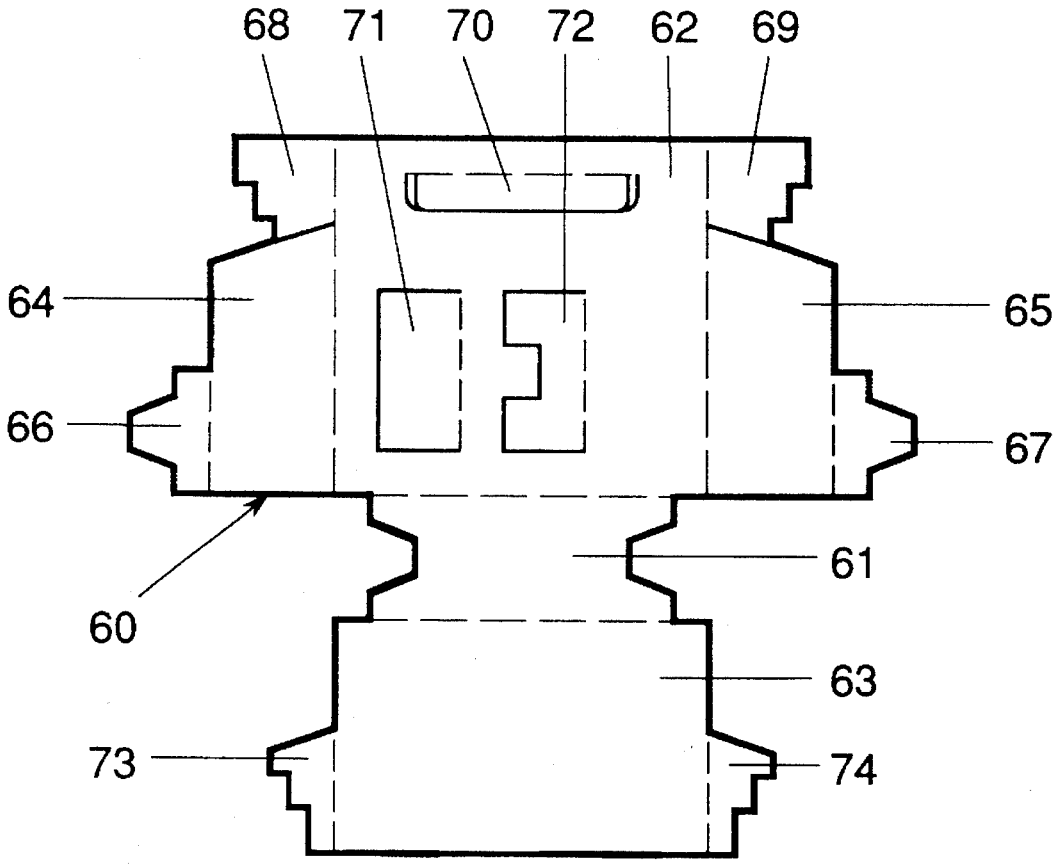
FIG. 17 shows a second embodiment of a blank to be used when forming a carrier according to the invention.

FIG. 17 shows a second embodiment of a blank. The blank 60 shown therein is provided with a first blank section 61, which is connected via hinge lines to a second blank section 62 and a third blank section 63. Via hinge lines a fourth blank section 64 and a fifth blank section 65 are connected to the second blank section 62. The fourth blank section 64 is connected via a hinge line to a tab-shaped portion 86, the fifth blank section to a tab-shaped portion 67. Above the fourth blank section 64 a flap-shaped portion 68 is hingedly connected to the second blank section 62, above the fifth blank section 65 a flap-shaped portion 69. Further, in the same manner as shown in FIG. 1, the second blank section 62 is provided with a flap-shaped portion 70, a first partition flap 71 and a second partition flap 72. Clearly departing from FIG. 1 are the further tab-shaped portions 73 and 74 secured to the third blank section 63 via hinge lines. The advantage of the blank 60 shown in FIG. 17 over the blank 1 shown in FIG. 1 is that the blank 60 requires less material, namely a strip having about the width of one tab-shaped portion 12 or 18, because the tab-shaped portions 66 and 67 do not extend over the full height of the fourth and fifth blank portions. In order yet to obtain over that full height a connection between the side and front walls in the erected form, there are provided further tab-shaped portions 73 and 74, which are in fact formed by a reduction of the surface of the flap-shaped portions 68 and 69. Less advantageous is that in the blank 60 additional folding operations must be carried out for the further tab-shaped portions 73 and 74, which are moreover connected to the third blank portion 63.

It is further observed that the blanks 60 also alternately adjoin one another without interspaces.

It is self-explanatory that many modifications and variants are possible within the scope of the invention as defined in the enclosed claims. Thus, after inserting the containers as shown in FIG. 9 two partly erected blanks could already be glued together with their second blank portions before carrying out the further folding and gluing operations for closing the front wall. Although reference is always made to gluing, any other eligible bonding technique can of course also be applied.

We claim:

1. A process for packaging containers in a carrier in two rows of each at least two pieces, in which process the carrier is made from two blanks and is at least partly erected around the containers and glued up, characterized by:

erecting a first blank to form and fill a first half carrier by feeding a first blank in a flat initial form, bringing a blank section forming a bottom of the carrier into a horizontal position, bringing a blank section forming a first longitudinal wall, hingedly connected to the bottom, into a vertically upward position from the bottom, folding at least one partition flap cut from the first longitudinal wall and two blank sections each forming a side wall of the carrier into a vertical position extending perpendicularly to the first longitudinal wall, inserting a container between a side wall and a flap, which container rests on the bottom and is in contact with the first longitudinal wall, bringing a blank section forming a second longitudinal wall, hingedly connected to the bottom, into a vertically upward position from the bottom, parallel to the first longitudinal wall, and connecting the blank section forming a second longitudinal wall both to one and to the other side wall, erecting a second blank equal to the first one to form a second half carrier and filling it, after which both half carriers are directed with a longitudinal wall towards each other and the longitudinal walls facing each other are interconnected to form a carrier with two rows of containers.

2. A process according to claim 1, characterized in that before inserting the containers the blank section forming the second longitudinal wall is folded into a position extending vertically downwards from the blank section forming the bottom.

3. A process according to claim 2, characterized in that after inserting the containers tab-shaped sections hingedly connected to the blank sections forming the side walls are directed towards each other in a position parallel to the blank section forming the first longitudinal wall, after which the blank section forming the second longitudinal wall is connected to the folded tab-shaped sections during or after bringing it into the vertically upward position.

4. A process according to claim 1, characterized in that after inserting the containers tab-shaped sections hingedly connected to the blank sections forming the side walls are directed towards each other in a position parallel to the blank section forming the first longitudinal wall, after which the blank section forming the second longitudinal wall is connected to the folded tab-shaped sections during or after bringing it into the vertically upward position.

5. A process according to claim 4, characterized in that the blank sections forming the longitudinal walls to be interconnected are provided with handle means.

6. A process according to claim 1, characterized in that the blank sections forming the longitudinal walls to be interconnected are provided with handle means.

7. A process according to claim 6, characterized in that the longitudinal walls to be interconnected are formed by the blank sections forming the first longitudinal walls.

8. An apparatus for packaging containers in a carrier in two rows by using first and second blanks, each blank provided with a first rectangular blank section having a first and a second long side and a first and second short side, the first and second short sides having a length substantially equal to a first transverse dimension of a container to be packaged, to which first and second long sides a second and a third rectangular blank section, respectively, are hingedly connected to the first blank section, which second and third blank section, at the location where they are connected to the first blank section, each have a first longitudinal side with a length substantially equal to a second transverse dimension of the container, extending perpendicular to the first transverse dimension, multiplied by the number of containers to be placed in a row, which second blank section has two longitudinal sides perpendicular to the first longitudinal side of the second blank section, each of the two longitudinal sides of the second blank section having a dimension substantially equal to that of one of the short sides of the first blank section plus that of one of the longitudinal sides of the third blank section extending transversely to the first longitudinal side and to which two longitudinal sides of the second blank section are hingedly connected a fourth and a fifth blank section, each having, perpendicular to the hinged connection, a dimension substantially equal to the first transverse dimension of a container to be packaged, the second blank section having cutting lines defining at least one hinged partition flap, characterized by means for transporting a first blank horizontally fed in flattened condition, and means for erecting and filling the first blank during transport, comprising:

means for folding into a vertically upward position the second blank section and the portions hingedly connected thereto, excepting the first blank section which remains in a horizontal position, means for folding the fourth blank section, each partition flap and the fifth blank section to above the first blank section, means for inserting a container between a folded fourth or fifth blank section and an adjoining partition flap as well as between two adjoining partition flaps, means for folding the third blank section into a vertically upward position, means for connecting the third blank section with the fourth and fifth blank sections, means for erecting and filling the second blank during transport, means for placing the first and second erected and filled blanks with their second blank sections against each other, and means for interconnecting two blanks thus placed against each other.

9. An apparatus according to claim 8, characterized by means for folding the third blank section into a vertically downward position combined with or adjoining the means for folding the second blank section into a vertically upward position.

10. An apparatus according to claim 8, wherein each blank comprises tab-shaped sections hingedly connected to the blank sections forming the side walls of a carrier and wherein the apparatus is characterized by means for folding tab-shaped portions hingedly connected on each of the fourth and fifth blank sections against a container, which means follow the means for inserting a container and precede the means for folding the third blank section into a vertically upward position.

11. An apparatus according to claim 10, wherein the second blank section is provided with an elongated U-shaped cut for forming a handle opening and the apparatus is characterized by means for cutting along the U-shaped cut and means for folding 180° and securing the tabs hingedly connected to the second blank section as well as means for folding 180° and securing the portion cut loose by the elongated U-shaped cut of the second blank section.

12. An apparatus according to claim 8, characterized in that the means for folding each partition flap and the trailing fifth blank section to above the first blank section are provided with an endless plate belt, of which the transport area extends parallel to the vertically upward second blank section and the plates are arranged perpendicularly to the transport area and at a mutual distance equal to a transverse dimension of a container to be packaged.

13. An apparatus for packaging containers in a carrier in two rows from first and second blanks each defining a first blank section and a second and a third blank section hingedly connected to the first blank section and fourth and fifth blank sections hingedly connected to the second blank section, the apparatus characterized by means for transporting the first blank horizontally fed in flattened condition, and means for erecting and filling the first blank during transport, comprising:

means for folding into a vertically upward position the second blank section and the portions hingedly connected thereto, excepting the first blank section which remains in a horizontal position, means for folding the fourth blank section and the fifth blank section to above the first blank section, means for inserting a container between folded fourth and fifth blank sections, means for folding the third blank section into a vertically upward position, means for connecting the third blank section with the fourth and fifth blank sections, means for erecting and filling the second blank during transport, means for placing two erected and filled blanks with their second blank sections against each other, and means for interconnecting two blanks thus placed against each other.

14. An apparatus according to claim 13, characterized by means for folding tab-shaped portions against a container, which means follow the means for inserting a container and precede the means for folding the third blank section into a vertically upward position.

15. An apparatus according to claim 14, characterized by means for folding 180° and securing tabs hingedly connected to the second blank section as well as means for folding 180° and securing a portion cut loose by an elongated U-shaped cut in the second blank section.

16. An apparatus according to claim 15, characterized by means for folding a partition flap and the trailing fifth blank section to above the first blank section provided with an endless plate belt, having a transport area extending parallel to the vertically upward second blank section and having plates arranged perpendicularly to the transport area and at a mutual distance equal to a transverse dimension of a container to be packaged.

* * * * *